United States Patent [19]

Berchem

[11] Patent Number: 4,461,513

[45] Date of Patent: Jul. 24, 1984

[54] ROTARY STONE-CUTTING HEAD

[75] Inventor: Rütger Berchem, Essen-Schuir, Fed. Rep. of Germany

[73] Assignee: Berchem & Schaberg GmbH, Gelsenkirchen, Fed. Rep. of Germany

[21] Appl. No.: 389,970

[22] Filed: Jun. 18, 1982

[30] Foreign Application Priority Data

Jun. 19, 1981 [DE] Fed. Rep. of Germany ..... 3123963

[51] Int. Cl.[3] ..... E21C 35/18

[52] U.S. Cl. ..... 299/88; 37/142 R; 175/413; 299/90

[58] Field of Search ..... 299/86, 90, 88; 175/410, 413; 37/141 T, 141 R, 142 R, 142 A

[56] References Cited

U.S. PATENT DOCUMENTS

| | | | |
|---|---|---|---|
| 2,861,908 | 11/1958 | Mickelson et al. | 37/142 R |
| 3,235,018 | 2/1966 | Troeppl | 175/413 X |
| 3,693,734 | 9/1972 | Richmond | 299/90 X |
| 3,737,199 | 6/1973 | Stephenson | 37/142 R X |
| 3,834,764 | 9/1974 | Krekeler | 299/88 X |
| 4,320,925 | 3/1982 | Bowes | 175/413 X |

*Primary Examiner*—Ernest R. Purser

*Attorney, Agent, or Firm*—Karl F. Ross; Herbert Dubno

[57] ABSTRACT

A rotary stone-cutting head has a body generally centered on and adapted to be rotated in a predetermined direction about an axis. An array of cutter supports on the body directed at least partially in the direction carry respective cutter teeth each having relative to the axis an outer cutting edge and relative to the direction a generally angularly forwardly directed face adjacent the edge and formed with an array of holding recesses. The teeth are at least at the edges of hardened metal. The teeth are removably secured to the respective supports and respective hardened-metal breaking pins have shanks fitted to the recesses and points directed angularly forwardly in the direction. At least some of the points lie angularly ahead in the direction of the respective cutting edge. These points having a crushing effect that greatly augments the effectiveness of the cutting edges.

8 Claims, 4 Drawing Figures

ROTARY STONE-CUTTING HEAD

FIELD OF THE INVENTION

The present invention relates to a rotary stone-cutting head. More particularly this invention concerns such a cutter which is used to drill or to remove or recover ore, coal, or the like.

BACKGROUND OF THE INVENTION

A rotary stone-cutting head normally has a body generally centered on and adapted to be rotated in a predetermined direction about a normally upright axis. One axial face, normally the bottom face, of this body has a plurality of teeth having cutting edges that are directed angularly generally forwardly in a predetermined direction of rotation of the body about its axis. A suction arrangement opens at the normally open center of the body so that chips and so on freed by the teeth are carried off, normally along with water or another liquid fed to the tool to lubricate and cool it as well as to serve as a vehicle for the freed chips.

These cutting edges therefore do virtually all of the removal work. Hence they get quite hot and are subjected to enormous wear. Thus it is standard practice to form these teeth of separate hardened-steel elements that are secured to the face of the drilling or cutting head. Appropriately edges small hardened-steel plates are therefore brazed or soldered to appropriate seats on the front or lower body face.

The main problem with this system is that the heat generated by the heavy-duty cutting and scraping at the cutting edges weakens the bond between the edge-forming elements and their supports. Hence these elements come loose and fall off, exposing the softer underlying metal—normally cast iron—to abrasion. Another problem is that the body surface normally erodes greatly around each such harder edge-forming element, so the body eventually becomes unusable.

OBJECTS OF THE INVENTION

It is therefore an object of the present invention to provide an improved cutting head of the above-described general type.

Another object is the provision of such a cutting head which overcomes the above-given disadvantages.

Yet another object is to provide a cutting head which will have a long service life.

SUMMARY OF THE INVENTION

These objects are attained according to the instant invention in a rotary stone-cutting head of the standard type, that is having a body generally centered on and adapted to be rotated in a predetermined direction about an axis. According to this invention an array of cutter supports on the body directed at least partially in the direction carry respective cutter teeth each having relative to the axis an outer cutting edge and relative to the direction a generally angularly forwardly directed face adjacent the edge and formed with an array of holding recesses. The teeth are at least at the edges of hardened metal. Means removably secures the teeth to the respective supports and respective hardened-metal breaking pins have shanks fitted to the recesses and points directed angularly forwardly in the direction. At least some of the points lie angularly ahead in the direction of the respective cutting edge.

These points have a crushing effect that greatly augments the effectiveness of the cutter head according to the instant invention. Preliminarily engaging the stone surfaces with these crushing or breaking points makes for much more efficient overall material removal in conjunction with subsequent cutting or peeling of the surface. In addition these pins strike hard nodes and the like before the cutting edges to reduce wear on these parts.

Normally according to this invention the recesses and shanks are cylindrical and perpendicular to the respective faces. The shanks can be force-fitted in place so they are a tight fit in the respective recesses or they can be rotatable in the respective recesses about respective axes perpendicular to the respective faces. They could even be brazed or soldered in place once fitted to the respective recesses.

According to another feature of this invention the teeth have respective centerlines and form respective circular orbits about the axis. The centerlines form acute angles with planes tangent to the respective orbit where crossed by the respective centerline. Thus the forces acting on the pins push them back into the respective recesses so they do not get knocked loose and so that force is transmitted effectively back to the respective tooth.

The tooth supports according to this invention are pins centered on the respective centerlines and the teeth fit complementarily over the respective pins. The supports and teeth are arrayed in spiral rows on the body. In addition the elements can be pyramidal or conical at the points. If appropriately positioned pyramidal elements or elements with strategically directed flat facets are used it is possible for them to direct the freed stone or the like in any desired direction.

According to this invention the recesses are through-going holes. Thus when the breaker pins must be replaced they can just be punched out and new ones can be driven in the bores forming the recesses.

The breaker pins according to this invention are formed of a conventional hard-metal alloy. The teeth, however, are formed of an alloy having the following composition by weight:

0.7% –1.0%: manganese,
0.7% –2.2%: chromium,
0.3% –0.6%: molybdenum,
0.5% –2.2%: nickel,
0% –0.45: carbon, and
balance: iron.

This Mn-Cr-Mo-Ni alloy is hardened by elongation, so-called stretch hardening done for example by forging, more than 6%, and preferably more than 8%, to have a strength of between 140 kp/mm$^2$ and 200 kp/mm$^2$, preferably 180 kp/mm$^2$. Thus hardened, it is bored out to receive the breaking-pin shanks.

DESCRIPTION OF THE DRAWING

The above and other features and advantages will become more readily apparent from the following, reference being made to the accompanying drawing in which.

SPECIFIC DESCRIPTION

Figure 1:
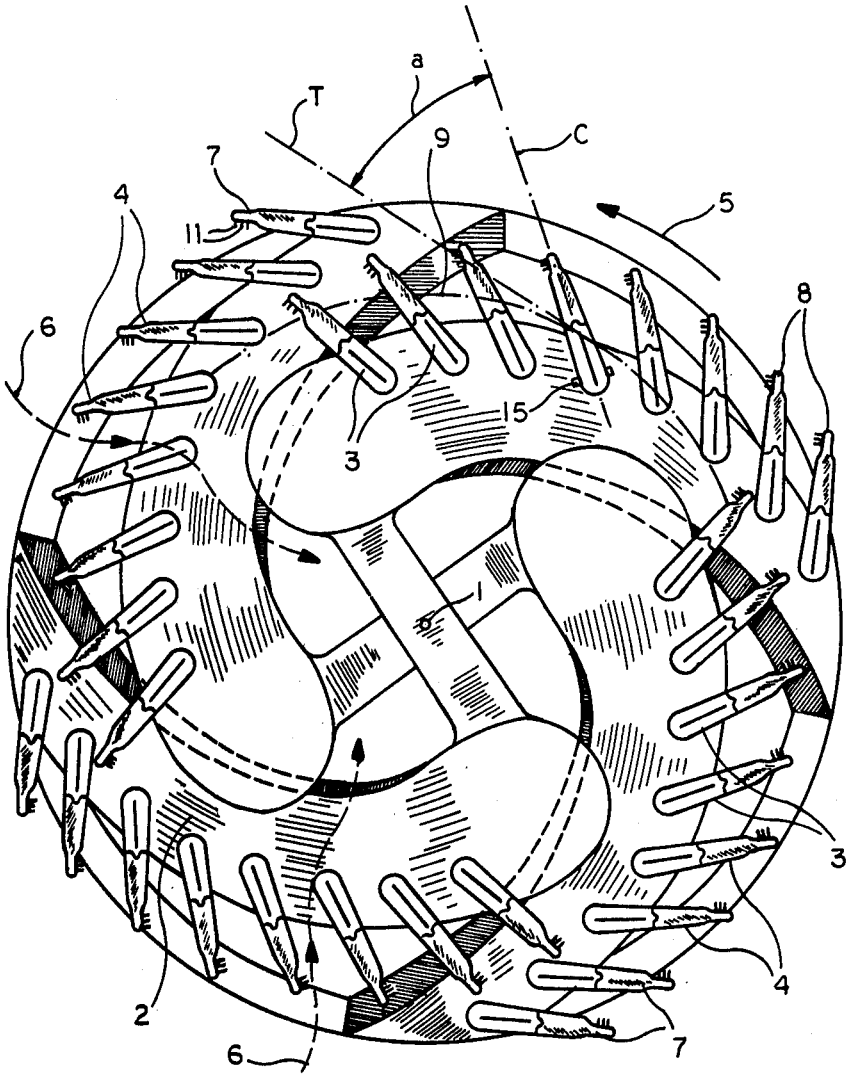
FIG. 1 is a partly schematic axial end view of the stone-cutting head according to the present invention.

As seen in FIG. 1, a cutter head centered on and rotatable about an axis 1 has a conventional four-element body 2 that is normally rotated in the direction indicated by arrow 5 about the axis 1 while it is pushed axially against stone to be cut away. This body 2 carries four part-spiral rows of identical cutting-tooth holders 3 carrying respective cutter teeth 7. The holders 3 and the respective teeth 7 have respective centerlines C (only one of which is shown) which form angles a of about 35° with respective lines T tangential to the orbit 9 of the respective teeth 7 as the body 2 rotates in direction 5 about the axis 1. Thus rock, ore, and the like can be broken off by these forwardly directed teeth 7 to move radially inwardly as indicated by arrows 6 to the open center of the body 2. Thence the broken-off material is normally aspirated with the water or other liquid that cools and lubricates the cutter.

Figure 2:
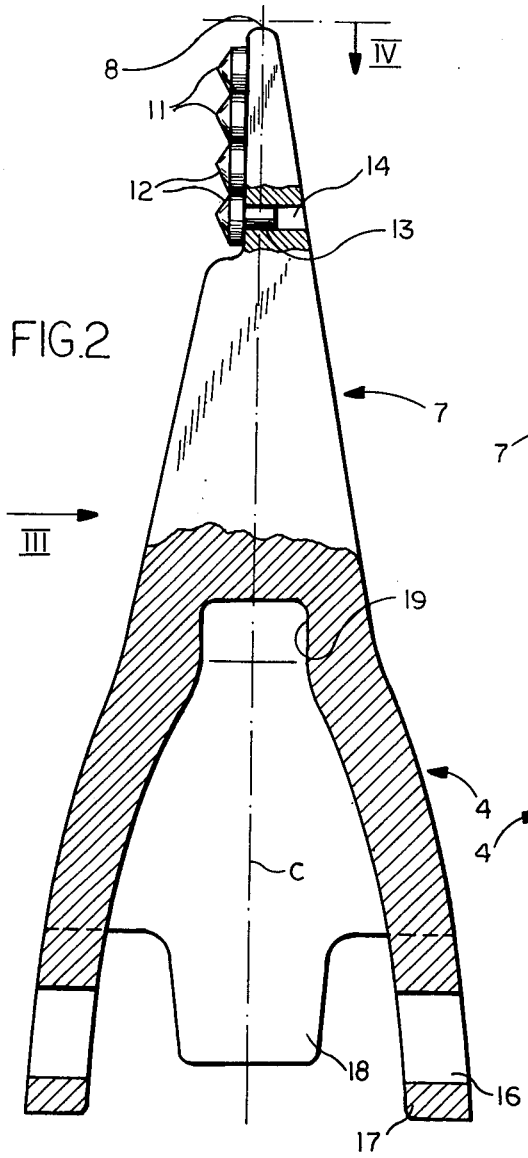
FIG. 2 is a large-scale side view partly in section through a cutter tooth according to the invention.
Figure 3:
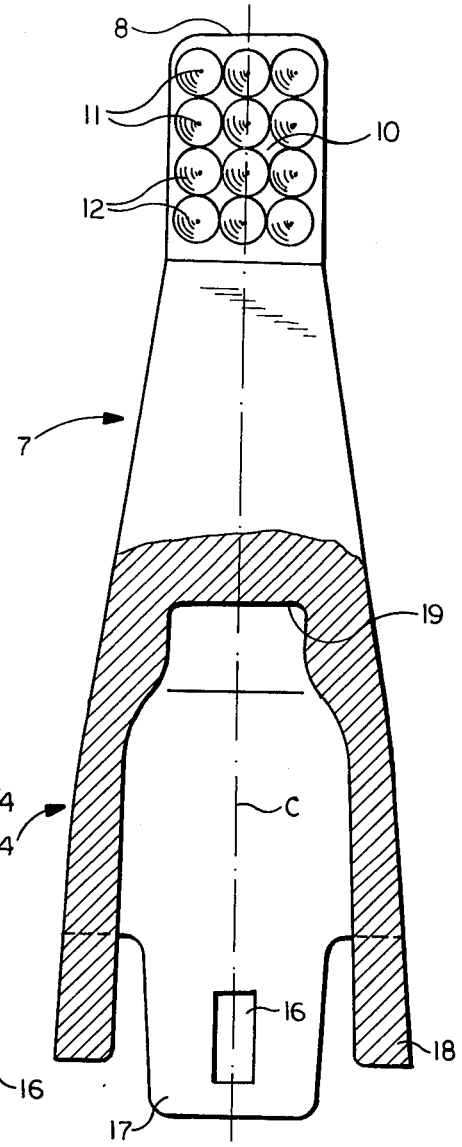
FIGS. 3 and 4 are views taken in the directions of respective arrows III and IV of FIG. 2, with FIG. 3 partly in section.
Figure 4:
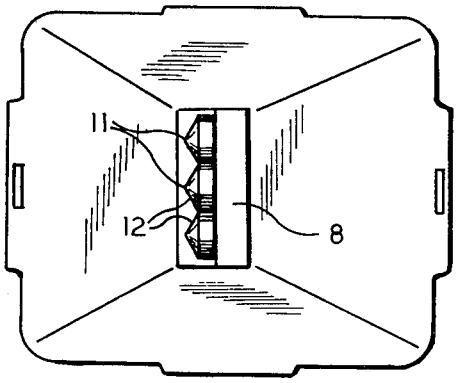

According to this invention as seen in FIGS. 2–4 each of the teeth 7 is a massive casting of Mn-Cr-Mo-Ni steel having the following composition by weight:

0.7% –1.0%: manganese,
0.7% –2.2%: chromium,
0.3% –0.6%: molybdenum,
0.5% –2.2%: nickel,
0% –0.45: carbon, and balance: iron.

This alloy is stretch-hardened more than 6%, preferably at least 8%, to have a strength of between 140 kp/mm$^2$ and 200 kp/mm$^2$, preferably 180 kp/mm$^2$. Each tooth 7 has an outer cutting edge 8 perpendicular to the respective centerline C. In addition each of these teeth 7 is formed with a recess 19 that fits complementarily over the respective pin-holder 3 and has front and rear (relative to direction 5) tabs 17 formed with throughgoing holes 16 through which a locking pin or key 15 (FIG. 1) extends, and side tabs 18 that merely brace it on the respective complementary pin 3. Thus each tooth 7 is effectively locked to the respective holder 3.

In addition each tooth 7 has a flat face 10 lying in a plane parallel to the respective straight cutting edge 8 and to the respective centerline C. A regular array of cylindrical holes 14 are bored in the tooth 7 after it is hardened. They open perpendicularly at this face 10 and receive the stems or shanks 13 of hardened-metal breaking elements 12 having heads formed with points 11 directed perpendicular to the surface 10. In use these points 11 are turned forwardly, that is at least generally in the direction 5, and in fact some of them lie ahead of the respective edges 8. The upper surfaces of the elements 12 are shown to be conical to form the points 11; they could also be pyramidal, with flat generally triangular facets.

These elements 12 therefore break and chip the face being cut by the edges 8. They greatly increase the removal rate and overall efficiency of the bit according to this invention.

Once the elements 12 are badly worn, they are simply punched out from the back and new ones can easily be mounted on the teeth 7. The stems 13 are force fitted in the holes 14 so that they are simply but solidly mounted. They may also be soldered or brazed in place, or even may be slightly loose so the pins 12 can turn about respective axes perpendicular to the respective face 10.

With the system of this invention, therefore, the overall efficiency (volume of material removed in a given unit of time) is increased enormously by the combined crushing and cutting effect. In addition the edges 8 wear much less than in prior-art machines. The pins 12 can be replaced relatively easily to renew the cutter right in the field without having to send it back to a well-equipped shop.

I claim:

1. A rotary stone-cutting head comprising:

a body generally centered on and adapted to be rotated in a predetermined direction about an axis;

an array of cutter supports on said body directed at least partially in said direction;

respective cutter teeth carried on said supports and each having relative to said axis an outer cutting edge and relative to said direction a generally angularly forwardly directed and generally rectangular face adjacent said edge and formed with an array of cylindrical holding recesses, said teeth being at least at said edges of hardened metal, having respective centerlines, and forming respective circular orbits about said axis, said centerline forming acute angles with planes tangent to the respective orbit where crossed by the respective centerline;

means for removably securing said teeth to the respective supports; and respective hardened-metal breaking pins having cylindrical shanks fitted to said recesses and conical or pyramidal points directed angularly forwardly in said direction and extending in said direction angularly forward beyond the face of the respective tooth, at least some of said points lying angularly ahead in said direction of the respective cutting edge.

2. The stone-cutting head defined in claim 1 wherein said recesses and shanks are cylindrical and perpendicular to the respective faces.

3. The stone-cutting head defined in claim 1 wherein said shanks are a tight fit in the respective recesses.

4. The stone-cutting head defined in claim 1 wherein said shanks are rotatable in the respective recesses about respective axes perpendicular to the respective faces.

5. The stone-cutting head defined in claim 1 wherein said teeth are formed of an alloy having the following composition by weight:

0.7% –1.0%: manganese,
0.7% –2.2%: chromium,
0.3% –0.6%: molybdenum,
0.5% –2.2%: nickel,
0% –0.45: carbon, and balance: iron, said alloy being stretch-hardened more than 6% to have a strength of between 140 kp/mm$^2$ and 200 kp/mm$^2$.

6. The stone-cutting head defined in claim 1 wherein said supports are pins centered on the respective centerlines and said teeth fit complementarily over the respective pins.

7. The stone-cutting head defined in claim 1 wherein said supports and teeth are arrayed in spiral rows on said body.

8. The stone-cutting head defined in claim 1 wherein said recesses are throughgoing holes.

* * * * *